US008393385B2

(12) United States Patent
Nitta et al.

(10) Patent No.: US 8,393,385 B2
(45) Date of Patent: Mar. 12, 2013

(54) HEAT EXCHANGING APPARATUS AND METHOD OF MAKING SAME

(75) Inventors: Minoru Nitta, Upland, CA (US); Takeyoshi Nitta, Upland, CA (US)

(73) Assignee: Mikutay Corporation, Upland, CA (US)

( * ) Notice: Subject to any disclaimer, the term of this patent is extended or adjusted under 35 U.S.C. 154(b) by 46 days.

(21) Appl. No.: 12/886,559

(22) Filed: Sep. 20, 2010

(65) Prior Publication Data

US 2011/0005722 A1 Jan. 13, 2011

Related U.S. Application Data

(63) Continuation-in-part of application No. 12/148,655, filed on Apr. 21, 2008, now Pat. No. 7,987,900.

(51) Int. Cl.
*F28F 3/12* (2006.01)
*F28F 1/40* (2006.01)

(52) U.S. Cl. ..... 165/170; 165/177; 29/890.053

(58) Field of Classification Search ..... 165/153, 165/170, 177; 29/890.053
See application file for complete search history.

(56) References Cited

U.S. PATENT DOCUMENTS

| | | | | | |
|---|---|---|---|---|---|
| 709,006 | A | | 9/1902 | Geurink | |
| 1,714,771 | A | * | 5/1929 | Fuchs | 165/170 |
| 1,844,308 | A | | 2/1932 | Armacost | |
| 1,946,234 | A | | 2/1934 | Price | |
| 2,274,965 | A | | 3/1942 | Kitto | |
| 2,752,127 | A | * | 6/1956 | Campe | 165/145 |
| 3,099,315 | A | | 7/1963 | Loehr | |
| 3,976,128 | A | | 8/1976 | Patel | |
| 4,332,293 | A | | 6/1982 | Hiramatsu | |
| 4,871,017 | A | * | 10/1989 | Cesaroni | 165/170 |
| 4,955,435 | A | * | 9/1990 | Shuster et al. | 165/170 |
| 5,211,222 | A | * | 5/1993 | Shinmura | 165/153 |
| 5,538,077 | A | * | 7/1996 | So et al. | 165/153 |
| 6,612,031 | B2 | | 9/2003 | Rhodes | |
| 2007/0215330 | A1 | | 9/2007 | Umetsu | |
| 2009/0260788 | A1 | | 10/2009 | Nitta | |

FOREIGN PATENT DOCUMENTS

| | | | |
|---|---|---|---|
| DE | 2249117 | A1 | 4/1974 |
| DE | 3300929 | A1 | 7/1984 |
| FR | 2898405 | A1 | 9/2007 |
| JP | S50-11257 | | 4/1975 |
| JP | S56-068795 | | 6/1981 |
| JP | 56154275 | | 11/1981 |
| JP | S58-154393 | | 10/1983 |
| JP | H10-306995 | A | 11/1998 |
| JP | 11287571 | | 10/1999 |

(Continued)

OTHER PUBLICATIONS

Japanese Patent Office, "Notification of Reasons for Rejection" re: Patent Application Serial No. 2011-506261, Drafting Date: May 24, 2012, 3 pages.

(Continued)

*Primary Examiner* — Leonard R Leo

(57) ABSTRACT

A heat exchanging device includes first and second disk members coupled together to form a disk unit having a chamber. The first disk member has an inlet and the second disk member has an outlet. At least one of the disk members has first and second connecting members coupled to the other disk member. The connecting members are arranged on opposite sides of a line extending axially through the inlet and outlet to define therebetween an inlet flow path above the line and outlet flow path below the line. A medium directing member is disposed within the disk unit. The medium directing member, the first and second connecting members and the chamber are arranged such that heat exchange media is directed to flow from the inlet, through the inlet flow path, through the chamber, through the outlet flow path, and into the outlet.

27 Claims, 4 Drawing Sheets

FOREIGN PATENT DOCUMENTS

| | | | |
|---|---|---|---|
| JP | 11287571 | A | 10/1999 |
| JP | 2006-336902 | A | 12/2006 |
| SU | 1814716 | A3 | 5/1993 |
| WO | WO 03/056267 | A1 | 7/2003 |
| WO | 2008/139651 | A1 | 11/2008 |

OTHER PUBLICATIONS

Korean Intellectual Property Office, "Notice of Preliminary Rejection" re: Patent Application Serial No. 10-2010-7025911, Date: Jun. 1, 2012, 4 pages.

Patent Office of the Russian Federation, "Decision on Grant, A Patent for Invention, Report on Results of Examination" re: Patent Application Serial No. 2010147367/06(068438); Date: Jul. 17, 2012, 13 pages.

State Intellectual Property Office of the People's Republic of China, "Notice of Second Office Action" Patent Application No. 200980114176.7 of Mikutay Corporation; Issue Date: Aug. 16, 2012; 27 pages.

* cited by examiner

HEAT EXCHANGING APPARATUS AND METHOD OF MAKING SAME

CROSS-REFERENCE TO RELATED APPLICATION

This application is a continuation-in-part of U.S. patent application Ser. No. 12/148,655, filed Apr. 21, 2008, now U.S. Pat. No. 7,987,900, and is related to U.S. patent application Ser. No. 12/856,179, filed Aug. 13, 2010, the entire contents of which are incorporated herein by reference.

BACKGROUND OF THE INVENTION

1. Field of Invention

The present invention relates to heat exchangers, specifically to a disk type heat exchanger unit with plurality of tubes and disk units for transporting heat exchange media within.

2. Discussion of the Related Art

There are various applications for heat exchangers where heat from one media is desired to be transported to another media. Typical heat exchangers are made of tubes with plurality of fin attachments on surface of tubes. Heat exchange media is transported through tubes, carrying heat within said heat exchange media. The heat transported through tubes by means of heat exchange media is transferred generally by means of conduction from heat exchange media to tube and fin structure of heat exchange assembly, as the heat exchange media flow through tubes. The tube and fin structure is surrounded by another heat exchange media, absorbing away heat from the tube and fin structure. The efficiency of a heat exchanger is generally dictated by the ratio of volumetric capacity of tubes to the overall surface area of tubes and fins. Typical application of this type of high performance heat exchangers are condensers and evaporators for use in commercial and residential air conditioner units. Variants of this type of heat exchangers are commonly utilized in commercial and automotive applications such as oil coolers, evaporators, condensers, heater cores, and radiators.

Efforts to enhance performance of heat exchangers is generally achieved by creating complex fin structures that have myriad bends and folds to create as much surface area within a given confine. Fins effectively increase surface area of tubes. In another effort to improve the performance, fins in addition to bends and folds may have plurality of louver features created on surface of fins. High performance heat exchangers are generally utilized where space is restricted, thus achieving higher performance with heat exchangers of smaller footprint. Enhancement efforts by means of utilizing complex fin structures may improve performance of heat exchangers, but potential additional manufacturing processes may adversely affect the total manufacturing cost of heat exchangers.

In another embodiment of this effort, instead of round tubes, flat tubes are made with plurality of small diameter holes. Generally of aluminum extrusion, intricate tubes are made with plurality of small diameter holes. To further improve performance of heat exchangers, thickness of a material used to create fins and tubes may be made thinner. By making the thickness of a material thinner, performance of a heat exchanger may be improved by shortening a distance that heat has to travel within walls of tube and fin structures, improving heat conduction efficiency. Thinning a material has the adverse effect of weakening a structure, however. Also, in an application such as automobiles where potential for debris hitting a heat exchanger surface is high, having a weak structure is not favorable, as a heat exchanger may be easily damaged, or worse having a puncture within tubes, causing heat exchange media within to leak out, rendering the heat exchanger useless. A manufacturing process of assembling together various heat exchanger components may be complicated as well, when components utilized are manufactured of thin walled tubes and fins. When components comprise of thin material, components are susceptible to damage during assembling process, requiring due care during assembly, typically raising manufacturing cost. Complication of manufacturing method typically has an adverse effect on the manufacturing cost, generally raising cost of individual components. Fragile components may also complicate handling of components during an assembly stage, as well as requiring stricter tolerance components as well as assembly machines capable of meeting strict tolerances, all of these factors typically resulting in higher component costs and assembly costs.

A variation on a tube-based heat exchanger involves stacking flat, ribbed plates. When said flat, ribbed plates are stacked upon each other, said plates create chambers for transferring heat exchanging media. In essence, this type of heat exchanger performs substantially in the same manner as tube-and-fin type heat exchangers, but is fabricated differently. This type of heat exchanger is commonly implemented by contemporary evaporators for automotive applications.

A variant of a disk type heat exchanger is described in Nitta, U.S. patent application Ser. No. 12/148,655 and Nitta, U.S. patent application Ser. No. 12/856,179 In theses embodiments, a heat exchanger core comprises of plurality of tube and chamber unit with a heat exchange media directing member disposed within. In these embodiments, a chamber is structurally supported by a heat exchange media directing member and a disk unit shell structure to prevent disk unit from deforming in high pressure application, such as for a condenser unit in an air conditioner application. The present invention improves upon these embodiments by having additional structural rigidity by means of connecting members connecting the second walls of the first disk member and the second disk member, providing additional structural rigidity to the disk unit, resisting the tendency for the disk unit walls to expand outwards when a chamber is supplied with heat exchange media under high pressure. The additional features in the present invention is beneficial in applications requiring high pressure environment for a heat exchange media, such as a condenser unit utilizing newer refrigerant, such as R-410, for example.

A first prior art example of a conventional tube and fin heat exchanger is described in Rhodes, U.S. Pat. No. 6,612,031. In this patent, an aluminum tube with multiple partitions within a tube is first extruded, and then cut into desired length. These tubes are then combined with additional fins, as tube surface alone is often insufficient and incapable of dissipating heat carried by a heat exchange media. Fins are sandwiched in between each row of tubes comprising a core of a heat exchanger. There are certain drawbacks to this type of heat exchanger cores. First, and foremost, tube extrusions with intricate inner partitions are very difficult to manufacture, requiring precision instruments to obtain a desired shape. Aluminum extrusion machines are typically utilized. An aluminum extrusion machine capable of manufacturing intricate extrusions are often very expensive machines, as well as being notoriously high in operating costs. The more intricate the extrusion shape, an aluminum extrusion machine's extrusion speed has to be reduced not only to obtained a desired shape, but also to protect an extrusion die, as complex extrusion shape causes the extrusion die to be very delicate, prone to damage. Due to the complex nature of extrusion machines, as well as slow operation and delicate extrusion dies that often break during operation, extruded tubes are sold at a relatively high cost, not to mention that there are only a handful of companies with extrusion machines capable of manufacturing intricate tube designs driving up costs. With tube and fin heat exchanger design, various components are combined together to form a heat exchanger core. These components are typically not designed to maintain its position in relation to each component in a standalone manner pursuant to a heat exchanger design parameters during an assembly process, prior to a brazing process which would braze together all components to form a unitary unit. As such, specialized assembly fixtures are often necessary during a manufacturing process to keep the parts together. As a fixture is critical in yielding a good working part, fixtures are often designed to close tolerances resulting in high cost. Also, as a fixture is needed for each heat exchanger assembled at a time, in a large manufacturing operations, where high volume of heat exchangers have to be manufactured at a time, a significant investment has to be made in fixtures, to have on hand enough sufficient quantity of assembly fixtures to support an assembly line. All these investments results in added costs to the manufacturing cost of tube and fin heat exchangers.

Fins utilized are generally of complicated design as described in a second prior art example of a conventional tube and fin heat exchanger in Hiramatsu, U.S. Pat. No. 4,332,293. In this patent, an aluminum tube is combined with corrugated fins to comprise a heat exchanger core. Fins discussed in this patent are corrugated to enhance performance of a heat exchanger. Corrugation is added to fins, as flat sheeted fins often do not yield a desired performance expectation. Therefore, fins are generally fabricated with corrugation feature at an additional fabrication cost and manufacturing processes.

A third prior art example of a conventional heat exchanger is commonly known as plate and fin heat exchangers described in Patel, U.S. Pat. No. 3,976,128. In this patent, instead of extruded tubes, individual tubes comprise of two formed plate halves, split along the long axis of the tube. By eliminating usage of extruded aluminum tubes, and by creating individual tubes by combining two formed plates, the main benefit is the cost savings, as formed plates are often less expensive to manufacture in comparison to aluminum extrusion tubes. As with tube and fin heat exchangers, however, tubes of plate and fin heat exchangers often do not have sufficient surface area in relation to the volumetric capacity of a tube assembly to dissipate heat carried by heat exchange media within, rendering a heat exchanger useless without additional surface area addition. In order to enhance performance of plate and fin heat exchangers, fin structures are sandwiched in between each row of formed plate tube structures to obtain added surface area to dissipate heat. There are certain drawbacks to this type of heat exchangers. First, and foremost, although the cost of components may be saved in comparison to extruded tubes, an assembly process of plate and fin heat exchanger remains similar to tube and fin heat exchangers, resulting in a complex assembly process often requiring a specialized assembly fixture to secure all components together until components are brazed together to form a unitary unit. The use of assembly fixture is often essential, driving up initial investment cost necessary to manufacture plate and fin heat exchangers, as significant investment has to be made in assembly fixtures for manufacture of specific configuration heat exchanger cores. Additionally, unlike extruded aluminum tubes, a plate and fin heat exchanger cannot be created with too much intricate details, as an assembly of two plate halves are often imprecise, and if a plate design is too intricate, the possibility of misaligning the two halves increase dramatically, rendering a completed heat exchanger useless. Therefore, plate and fin heat exchangers are commonly designed with larger inner partitions, typically resulting in lower performance than extruded aluminum tubes. Another common disadvantage with plate and fin heat exchangers is due to the nature of the design of stacking together plurality of plates without much opening between individual plates. With reduced opening between individual plates, a heat exchange efficiency from a heat exchanger surface to an atmosphere surrounding a heat exchanger, media such as air, is often poor, leading to a low efficiency heat exchanger performance.

SUMMARY OF THE INVENTION

The present invention is an enhanced heat exchanging apparatus with disk type heat exchanger core comprising of disk units having connecting members integrally of disk units to enhance structural rigidity in high internal pressure applications. A disk type heat exchanger core comprises of plurality of disk units. Disk units are formed by combining two disk members, a first disk member comprising first end of the disk unit, having an inlet formed as a tubular member on first side of the first disk member, and a second disk member comprising the other end of the disk unit, having an outlet formed as a tubular member on first side of the second disk member. The first disk member has connecting members generally surrounding the inlet of the first disk member on the second side of said disk member, an inlet flow path and an outlet flow path provided to allow passage of heat exchange media herein. In a preferred embodiment of the present invention, connecting members are integral component of a first disk member, formed as protrusion members on the second side of the first disk member. Generally, connecting members are formed on second side of the first disk member as protrusion members by forming the face of the second side of the first disk member by utilizing stamping dies, for example. The first disk member and the second disk member are coupled together on respective second side of said disk members creating a disk unit, top surface of connecting members on the first disk member engaging the second side of the second disk member. Generally, disk units are made of aluminum with cladding on one or both sides of a material. As such, connecting members, when the disk unit is processed through an operation such as a brazing process by which the clad material is melted to form a braze fillet, connecting members on the second side of a first disk member form a brazed joint between the first disk member and the second disk member, forming a strong union between the first disk member and the second disk member. By having a stepped surface on the second side of the first disk member as a result of having connecting members on the second side of the first disk member, a gap is formed between the respective second side of the first disk member and the second disk member, creating a chamber between the first disk member and the second disk member to allow flow of heat exchange media herein. Disposed within said disk unit is a heat exchange medium directing member. A heat exchange medium directing member is generally of a cylindrical member with first end of the generally cylindrical member end coupled to an inlet of the first disk member. Said first end of the heat exchange medium directing member has a channel cut into a face of the first end of said heat exchange media directing member, said channel cut at an angle generally between 30 to 45 degrees to facilitate flow of heat exchange media without much resistance. Second end of said heat exchange medium directing member also has a channel cut an angle, said channel cut at an angle generally between 30 to 45 degrees to facilitate flow of heat exchange media without much resistance.

In the present embodiment, heat exchange media first flows in to a disk unit through an inlet on a first disk member. The heat exchange media then flows through an inlet flow path provided as a pathway through connecting members on a second side of the first disk member, guiding the heat exchange media to a chamber within the disk unit. The heat exchange media when guided in to the chamber is directed substantially to one side of the chamber by a heat exchange media directing member. Once the heat exchange media flows into the chamber, the heat exchange media is guided towards the other end of the chamber, flow directed by the contour of the chamber wall. The second end of the heat exchange media directing member also has a channel cut at an angle on a side typically diagonally opposite from the channel on the first side, to facilitate flow of heat exchange media herein. The heat exchange media that was introduced into the disk unit from the disk inlet on the first disk member that has then flowed in the chamber, following the wall contour of the chamber is then drained out of the disk unit through the outlet formed on the second disk member. The heat exchange media is directed towards the outlet on the second disk member from the chamber by the outlet flow path provided as a pathway through connecting members on the first disk member. The heat exchange media is then led to the outlet on the second disk member by the heat exchange media directing member disposed within the disk unit. Plurality of said disk units may be coupled together to form a single unitary unit. When one or more disk units are combined to form a single unit, an outlet of a first disk unit may be coupled to an inlet of a second disk unit. This arrangement is repeated as needed to obtain a unitary unit with a desired disk unit quantity. One end of said single unitary unit of plurality of disk units may be coupled on one end to a first header or a manifold. The other end of said unitary unit of plurality of disk units may be coupled to a second header or a manifold member. Plurality of said unitary unit of plurality of disk units may be coupled on first end with a first manifold member, and second end coupled with a second manifold member. One or more baffles may be disposed within first and second manifold to facilitate desired heat exchange media flow pattern.

In another embodiment of the present invention, connecting members on a second side of a first disk member may not be an integral component of the first disk member, but in a form of separate components, a connecting members formed in a desired shape to facilitate connection between the first disk member and the second disk member. In this embodiment, connecting members are not integrally formed on the second side of the first disk member, but similarly functioning separate components are inserted within the disk unit to serve as structural connections between the second side of the first disk member and the second side of the second disk member. Said separate connecting member may comprise of cladded material, allowing for said members to form a strong joint by means of a brazing process. Said cladded material in a preferred embodiment would be a double sided clad material. However, in another embodiment, if disk units themselves are cladded material, with the clad side on respective second side of the first disk member and the second disk member, connecting members may not be cladded material.

The present invention is also a method of making a disk type heat exchanging apparatus. The method includes the steps of providing a first generally planar material having a tubular member formed on first side of said material, creating an inlet on the material. The method includes a step of forming said material by cutting out a desired shaped disk member, removing away excess material, creating a first disk member. The method includes a step of forming connecting members on second side of said material. Said connecting members formed by plurality of folds on the second side of said material, said folds created by utilizing stamping dies comprising of a top die and a bottom die that when pressed together yields a desired shape. The method includes the steps of providing a second generally planar material having a tubular member formed on first side of said material, creating an outlet on the material. The method includes the step of forming said second material by cutting out a desired shaped disk member, removing away excess material, creating a second disk member. The method further includes the step of making an annular bend on the outer edge of said second material forming an annular wall projecting outwardly from the second side of said material. The method includes the steps of providing a generally cylindrical material, said material having a channel cut at an angle on both ends, creating a heat exchange directing member. The method further includes the steps of disposing said heat exchange medium directing member, first end of the heat exchange medium directing member engaging the inlet of the first disk member, second end of said heat exchange medium directing member engaging the outlet of the second disk member. The method further includes the steps of coupling said first disk member and second disk member, connecting members on the first disk member engaging the second side of the second disk member, creating a chamber between the respective second side of first disk member and the second disk member, forming a disk unit. The method includes the step of bending the annular wall on the second disk member onto the first disk member, coupling the first disk member and the second disk member together. The method further includes steps of coupling plurality of said disk units, outlet of a first disk unit engaging an inlet of a second disk unit.

In an embodiment of the present invention, the method includes providing first material and second material that are generally planar sheet material, formed into desired shape by stamping said materials, an inlet on the first material and an outlet on the second material formed by forming said materials. The method further includes placing connecting members between the second sides of the first material and second disk material, disposed generally around the inlet of the first material. The method further includes a step of creating a generally annular bend on the outer periphery of the second material, made generally perpendicular from the second face of said material, forming an annular wall projecting outwardly from the second side of said material. The method includes the steps of coupling said first material and said second material on respective second side of materials, first face of connecting members engaging the second side of the first material, and second face of connecting members engaging the second side of second material. As the connecting members are disposed between the second side of first material and second material, a gap is formed between the second side of the first material and the second side of second material where connecting members are not present, forming a chamber. The method further includes the steps of bending the annular wall on the second material on to the first side of the first material, coupling said materials together, forming a disk unit. The method further includes the steps of providing a generally cylindrical material, said material having a channel cut at an angle on both ends, creating a heat exchange medium directing member. The method further includes the steps of disposing said heat exchange medium directing member in the disk unit. The method further includes the steps of coupling plurality of said disk units, outlet of a first disk unit engaging an inlet of a second disk unit.

In another embodiment of the present invention, the first material and second material may be formed by machining said materials, removing away excess material from said materials until a desired shape is achieved.

In an embodiment of the present invention, disk type heat exchangers are provided, for example, for a condenser, evaporator, radiator, etc. The heat exchanger may also be a heater core, intercooler, or an oil cooler for various applications. An advantage of the present invention is that the heat exchange media is introduced into a chamber within individual disk units, thereby increasing the surface area that a heat exchange media comes in to contact within a heat exchanger, improving the efficiency of heat exchangers. Conventional heat exchangers, wherein heat exchange media flows in a generally round tube, heat exchange media flows in layers, carrying varying amount of heat within each layer. In such an arrangement, heat exchange media closest to a tube surface may more effectively transfer heat from heat exchange media to the tube surface. However, heat exchange media closer to center of the tube may be less efficient at transferring heat on to the tube surface, as heat has to travel through different layers of heat exchange media generally by conduction, in order to reach the tube surface. In comparison, present invention improves heat transfer efficiency of heat exchange media by spreading out the heat exchange media in a chamber, thereby increasing the heat exchange media to heat exchanger surface contact, increasing heat transfer efficiency. A chamber also has an added benefit of reducing the distance heat has to travel within heat exchange media thereby improving heat exchange efficiency, as spreading the heat exchange media flat and thin has an added benefit of creating a thinner layer of heat exchange media. Another advantage of the present invention is that a heat exchange media directing member coupled within a disk unit effectively routes heat exchange media to contact heat exchanger surface more effectively. A heat exchange media directing member also has an added benefit of effectively mixing and stirring heat exchange media within a disk unit chamber preventing laminar flow of heat exchange media, thereby increasing heat exchange efficiency. As heat exchange efficiency is improved in the present invention, overall size of a heat exchanger may be made smaller compared to a conventional heat exchanger of equal capacity, which in turn provides for a lower overall cost as less raw material and less packaging is necessary. Furthermore, the smaller footprint of the present invention lends itself to be used in applications where space is limited. Yet another advantage of the present invention over a conventional heat exchanger is that a manufacturing process may be simpler because the present invention requires less fragile components and less manufacturing steps. Conventional heat exchangers typically require extensive investment in preparing assembly fixtures, as various components may fall out of place during assembly without assembly fixtures. Furthermore, conventional heat exchangers require new assembly fixtures to be created for each heat exchanger core design change, even if component level parts remain the same. The present invention improves upon conventional heat exchanger manufacturing process, as entire unit may be brazed together, or any portion of the unit may be brazed first, and then additional components may be brazed or soldered together without use of assembly fixtures if necessary, significantly reducing an investment in assembly fixtures.

In another embodiment of the present invention, tube size may vary between disk units. A disk unit size may vary from one disk unit to the other.

In yet another embodiment of the present invention, to further enhance the performance, additional fin material may be added to disk units.

In a further embodiment of the present invention, each media directing member inside a disk unit may be rotated at a predetermined angle from each other.

In another embodiment of the present invention, disk units may be brazed or soldered together to form a unitary unit.

In yet another embodiment of the present invention, disk units may be made of aluminum, either with cladding or without cladding. Disk units may also be made of stainless steel, copper or other ferrous or non-ferrous materials. Disk units may also be a plastic material or other composite materials. Disk units may also be made of combination of any or all of the mentioned materials.

In another embodiment of the present invention, disk units may be manufactured by stamping, cold forging, or machining.

In a further embodiment of the present invention, disk units may be brazed together or soldered together to form a unitary unit.

In a further embodiment of the present invention, disk units may be round, oval, or any other geometric shape.

Other features and advantages of the present invention will be readily appreciated, as the same becomes better understood after reading the subsequent description taken in conjunction with the accompanied drawings.

DETAILED DESCRIPTION

The present invention is directed to a disk type heat exchanging apparatus having a heat exchange media directing member within, useful in applications requiring heat exchange from one heat exchange media to another heat exchange media.

The details of embodiments of heat exchange media flow within a chamber is described in US PAT. application referred to above such as Nitta, U.S. patent application Ser. No. 12/148,655, the disclosure of which is hereby incorporated by reference in its entirety.

Figure 1A:
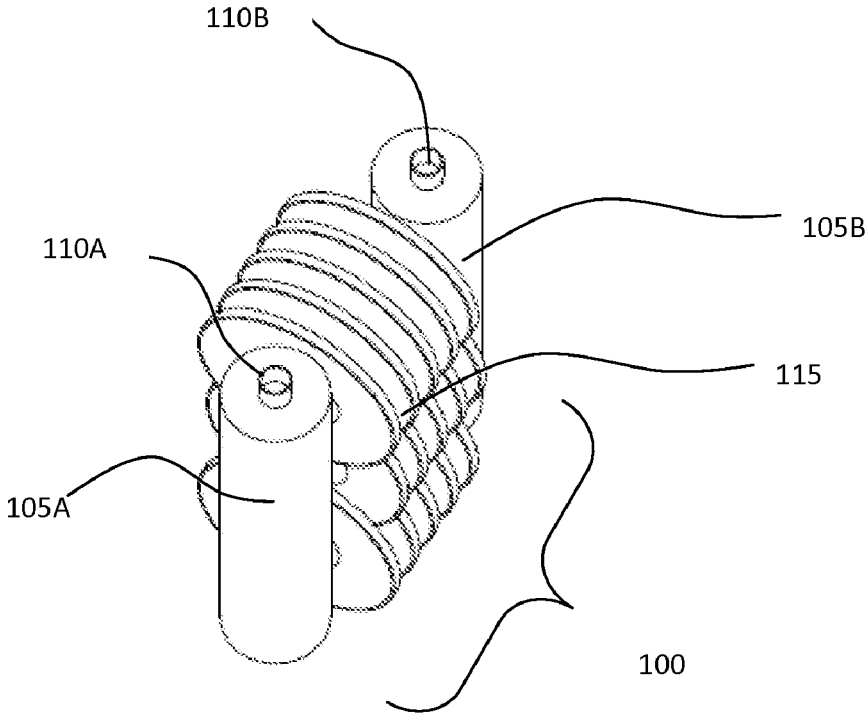
FIG. 1A is a perspective view of a disk type heat exchanger according to embodiments of the present invention.

Referring to the drawings and in particular FIG. 1A, an embodiment of a disk type heat exchanger 100 is shown. The heat exchanger 100 comprises of plurality of disk units 115. Predetermined quantity of disk units 115 are coupled together to form a unitary unit of plurality of disk units. Each unit of plurality of disk units may be coupled by two manifolds 105A and 105B, said manifolds having plurality of holes to couple ends of plurality of disk units. Manifolds 105A and 105B are typically arranged in a parallel fashion, set apart to a predetermined length to couple first end of plurality of disk units to manifold 105A, and second end of plurality of disk units to manifold 105B. Manifolds 105A and 105B facilitate flow of heat exchange media between individual rows of plurality of disk units. More than one unit of plurality of disk units may be coupled to manifolds 105A and 105B to obtain desired heat exchange performance. Generally speaking, more rows of plurality of disk units, the higher the performance of a heat exchanger. Manifolds 105A may have an inlet 110A to introduce heat exchange media to a heat exchanger unit 100. Heat exchange media flowing in through a heat exchanger 100 may exit through outlet 110B. Manifolds 105A and 105B may have one or more baffles to obtain desired flow pattern between individual rows of plurality of disk units. As heat exchange media flow through the heat exchanger 100, the heat from the heat exchange media is transferred to the material comprising individual disk units 115. The heat from the heat exchange media that has been absorbed by the material comprising individual disk units 115 is transferred to a heat exchange media surrounding the exterior of the heat exchanger 100. Heat exchange media utilized within a heat exchanger 100, and heat exchange media on the exterior of a heat exchanger varies by application. For example, in an application for an air conditioner evaporator, heat exchange media utilized within a heat exchanger may be a refrigerant, such as R-410. The heat exchange media surrounding the evaporator in such an application may be air. The composition of heat exchange media may be a combination of any and all known heat carrying media known in the art. Although not meant to be limiting, common heat exchange media know in the art includes various refrigerants (i.e., R-410, R-134, R-22), carbon dioxide, butane, propane, oils, gases (e.g., air), water, and mixture of water and other coolants (e.g. ethylene glycol).

Figure 1B:
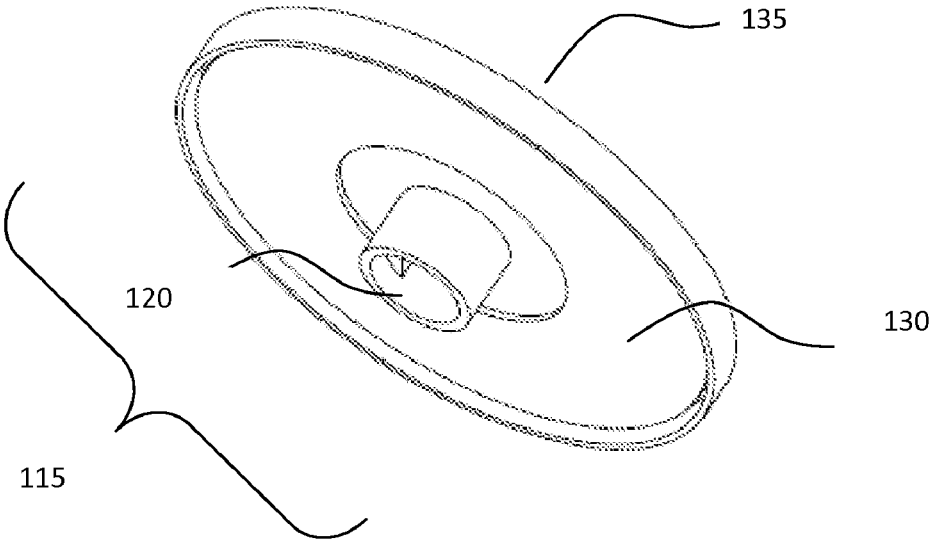
FIG. 1B is a perspective view of a disk unit according to embodiments of the present invention.
Figure 2A:
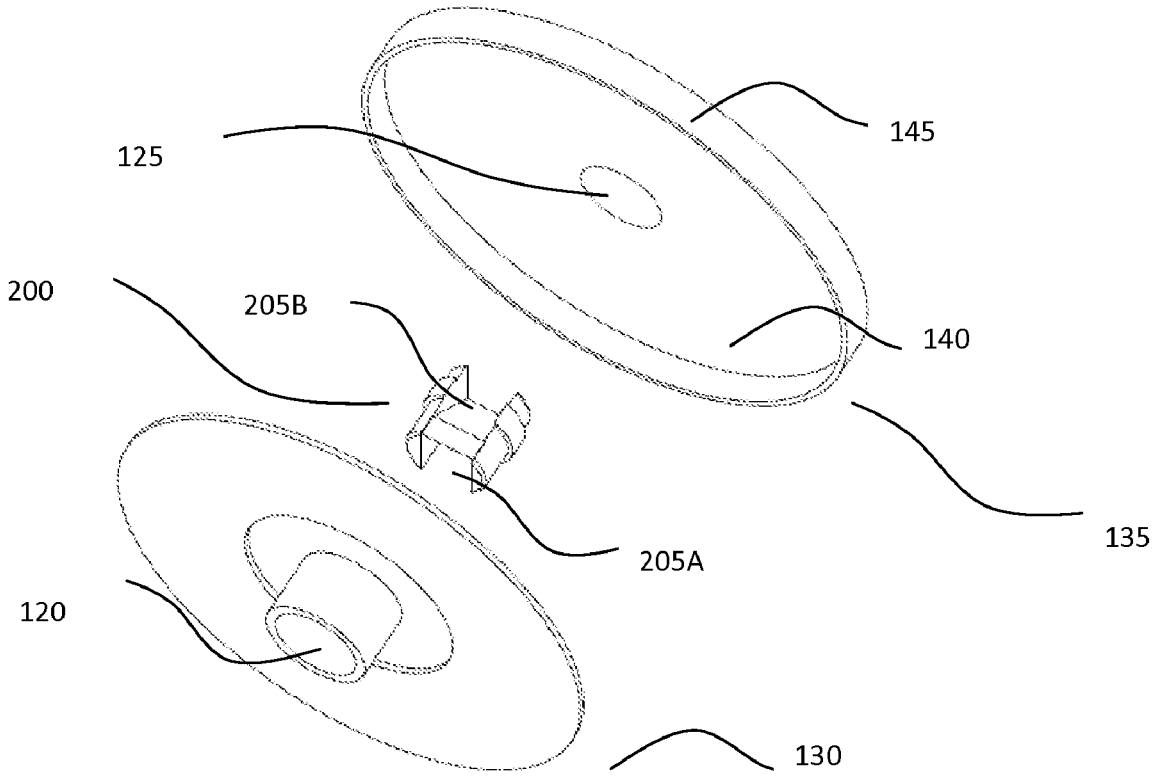
FIG. 2A is an exploded view of a disk unit according to embodiments of the present invention.
Figure 2B:
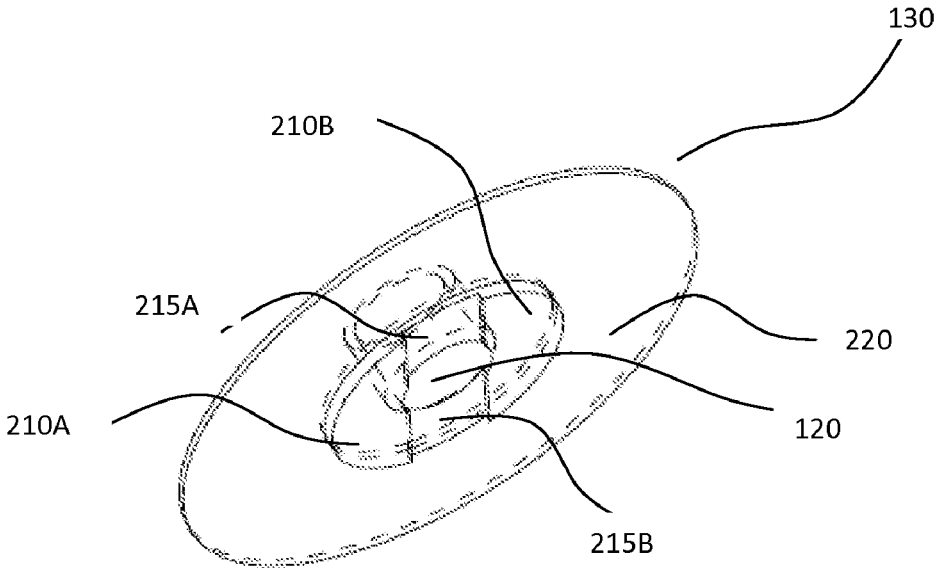
FIG. 2B is a perspective view of a second side of a first disk member according to embodiments of the present invention.
Figure 3A:
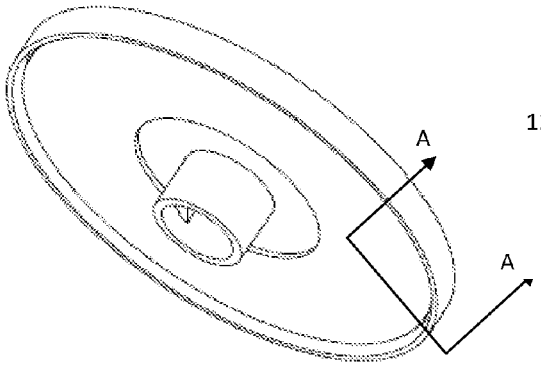
FIG. 3A is yet another perspective view of a disk unit according to embodiments of the present invention.
Figure 3B:
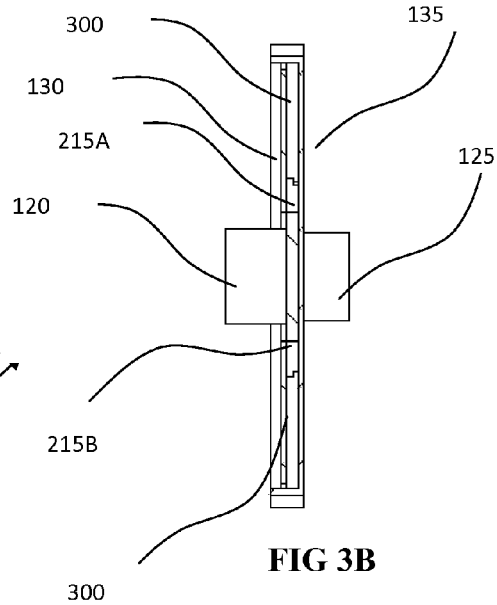
FIG. 3B is a side cutout view of a disk unit according to embodiments of the present invention.

Referring to FIG. 1B and FIG. 2A, a disk unit 115 comprises of a first disk member 130, an inlet 120 formed as a tubular member on a first side of the first disk member, and a second disk member 135, an outlet 125 formed as a tubular member on a first side of the second disk member. Said first disk member 130 and said second disk member 135 are coupled together on respective second sides of said disk members. Referring to FIGS. 2A and 2B, connecting members 210A and 210B on the second side of the first disk member 130 engaging engage the second side 140 of the second disk member. In this embodiment, connection members 210A and 210B on the second side of the first disk member are formed as protrusion members, extending outwardly from the second side of the first disk member 130. Referring to FIG. 3B, the second side of the first disk member 220, and the second side of the second disk member 140 that are not covered by or connected to connecting members 210A and 210B becomes become chamber 300 to facilitate flow of heat exchange media therein. Referring to FIG. 2A and FIG. 2B, a heat exchange media directing member 200 is disposed within said disk unit 115, a first end of the heat exchange media directing member engaging the inlet on the first disk member 130. Said first end of heat exchange media directing member 200 has a channel 205A cut at an angle. Channel 205A directs heat exchange media flowing in from the inlet 120 on the first disk member to inlet flow path 215A. The inlet flow path 215A facilitates flow of heat exchange media from the inlet 120 to the chamber 300. A second side of the heat exchange media directing member 200 engages the outlet 125 on the second disk member. Said second side of heat exchange media directing member 200 has a channel 205B cut at an angle. Channel 205B directs heat exchange media out of the disk unit 115 via the outlet 125. Heat exchange media that was introduced into the chamber 300 is directed towards the channel 205B by outlet flow path 215B.

Figure 3C:
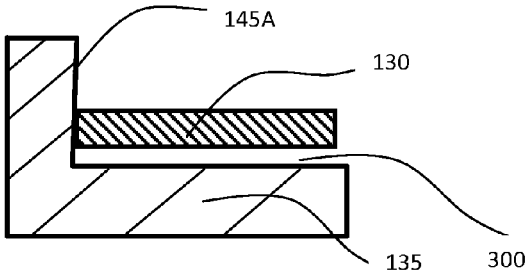
FIG. 3C is a section view illustrating a side view of section A-A of FIG. 3A, showing an annular wall on a second disk member prior to a coupling process according to embodiments of the present invention.

Referring to FIG. 3B and FIG. 3C, a second disk member 135 has an annular wall 145A, generally projecting outwardly from a second side of a second disk member, the base of said wall generally is connected to the second side of the second disk member. In a typical embodiment, the overall disk diameter of a first disk member is made slightly smaller than the inner diameter of the annular wall formed on a second disk member, allowing the first disk member 130 to be matingly coupled within the annular wall 145A of the second disk member. Generally, the first disk member 130 is pressed in within the annular wall 145A of the second disk member, allowing the top face of the connecting members 210A and 210B to contact the second side of the second disk member. As the top face of the connecting members 210A and 210B protrudes outward from the second side of the first disk member, when the connecting members 210A and 210B engages the second side of the second disk member, chamber 300 is created between the second side of the first disk member and the second disk member.

Figure 3D:
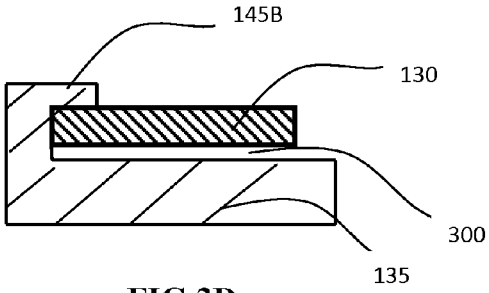
FIG. 3D is a section view illustrating a side view of section A-A of FIG. 3A, showing an annular wall on a second disk member after a coupling process according to embodiments of the present invention.
Figure 3E:
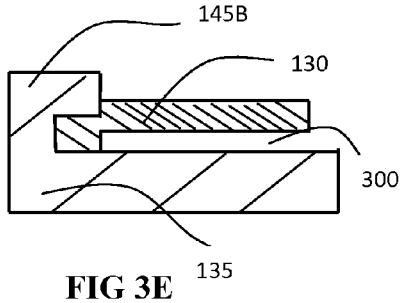
FIG. 3E is a section view illustrating a side view of section A-A of FIG. 3A, showing an annular wall on a second disk member after a coupling process according to another embodiments of the present invention.

Referring to FIG. 3C and FIG. 3D, once the first disk member is pressed in to the second disk member, generally annular wall 145 is bent in a folding fashion, coupling the first disk member and second disk member together. Generally annular wall 145 is folded in, so that the chamber 300 is left intact. In another embodiment, as the generally annular wall 145 is bent in, outer periphery of the first disk member is allowed to bend as the generally annular wall 145 is pressed down towards the first disk member, as illustrated in FIG. 3E. In this embodiment, outer periphery of the second side of the first disk member engages the second side of the second disk member, leaving the chamber 300, but the cubic area of chamber 300 is reduced slightly than in other embodiments.

Figure 4A:
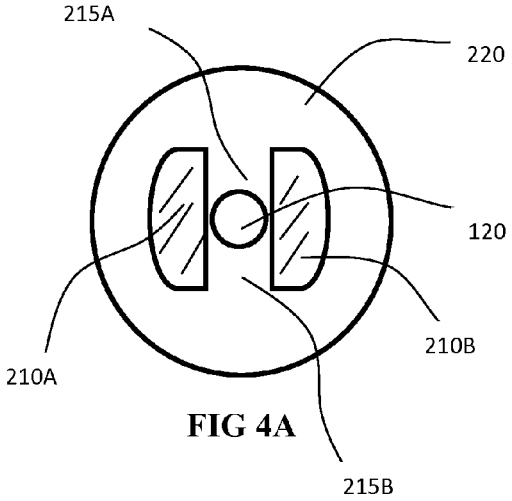
FIG. 4A is a top view of a second side of a first disk member according to embodiments of the present invention.
Figure 4B:
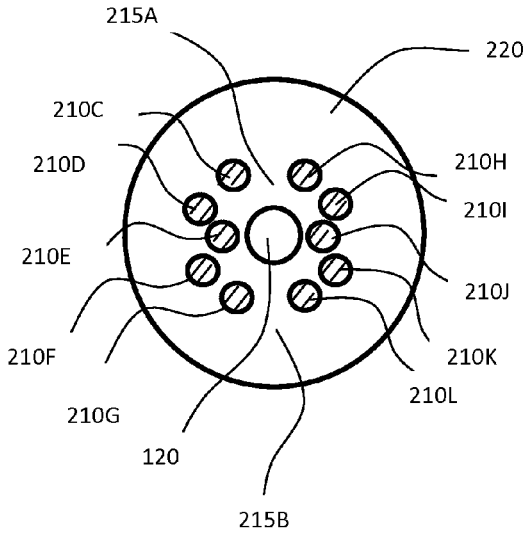
FIG. 4B is a top view of a second side of a first disk member according to another embodiments of the present invention.
Figure 4C:
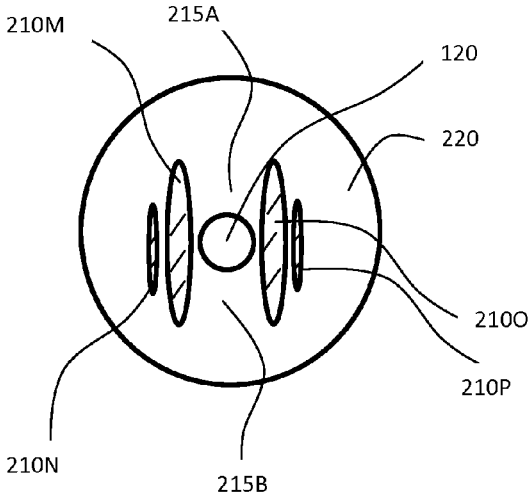
FIG. 4C is a top view of a second side of a first disk member according to yet another embodiments of the present invention.
Figure 4D:
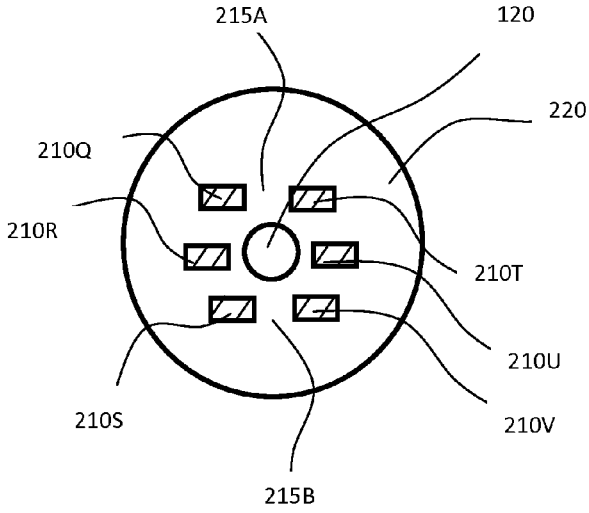
FIG. 4D is a top view of a second side of a first disk member according to another embodiments of the present invention.

There are many embodiments of connecting members, as illustrated in FIG. 4A, FIG. 4B, FIG. 4C, and FIG. 4D. FIG. 4A illustrates the present embodiment, having two protrusion members 210A and 210B aligned generally parallel to each other, leaving an inlet flow path 215A and an outlet flow path 215B between said two protrusion members. In another embodiment, the two connecting members may comprise a plurality of generally circular protrusion members, as illustrated in FIG. 4B. In yet another embodiment, connecting members may comprise a plurality of rows of connecting members, as illustrated in FIG. 4C. In another embodiment, connecting members may comprise a plurality of generally rectangular protrusion members as illustrated in FIG. 4D. In a typical embodiment, material with clad material on one or both side of a material is utilized to fabricate a disk member. The clad is designed to melt at a temperature lower than the melting temperature of a base material. Typically, the side of the disk member with the connecting members is made with clad material. Therefore, when the disk units are brazed together, even when plurality of connecting members comprise a connecting member, a braze fillet is typically formed between the plurality of connecting members, forming a single unitary connecting member. Generally, connecting members comprise a pair of connecting members, as with 210A and 210B. However, in other embodiments, each connecting member may comprise a plurality of smaller connecting members. Referring to FIG. 4B, a plurality of smaller diameter connecting members 210C, 210D, 210E, 210F, and 210G comprise a set of connecting members, the smaller connecting members functioning function similarly to connecting member 210A. A second plurality of connecting members 210H, 2101, 210J, 210K, and 210L comprise the other set of smaller connecting members. Said second set of plurality of smaller connecting members functioning similarly to connecting member 210B. Quantities of smaller connecting members may vary by application. Shape, as well as arrangement of smaller connecting members may vary by application.

When plurality of disk units is combined together to form a single unitary unit as illustrated in FIG. 1A, disk units may be coupled together between consecutive disk units by coupling a second inlet 120 and a first outlet 125, forming a tubular member. To facilitate ease of assembly, the inlet 120 may be manufactured with an outside diameter that is substantially the same as an inside diameter of the outlet 125. When more than one disk unit is coupled together, the inlet 120 may be disposed in outlet 125, forming a tubular unit. Conversely, the inlet 120 may be manufactured with an inside diameter that is substantially the same as outside diameter of the outlet 125. When more than one disk unit is coupled together, the outlet 125 may be coupled to the inlet 120. In yet another embodiment of the present invention, inlet 120 and outlet 125 may be of substantially the same diameter, plurality of disk units attached in a butt-joint method. In such embodiment, a sleeve may be utilized to overlap the inlet 120 and outlet 125, allowing for ease of assembly.

Many modifications and variations of the present invention are possible in light of the above teachings. Therefore, within the scope of the appended claims, the present invention may be practiced other than as specifically described.

The invention claimed is:

1. A heat exchanging device comprising:

a first disk member having an inlet formed as a tubular member on a first side of the first disk member;

a second disk member having an outlet formed as a tubular member on a first side of the second disk member, an outer periphery of the second sides of the first and second disk members engaging each other to form a disk unit, said disk unit having a chamber to facilitate flow of a heat exchange medium therein, at least one of the first and second disk members having on its second side first and second connecting members coupled to the other disk member and disposed on opposite sides of a line extending axially through the inlet and the outlet to define therebetween an inlet flow path on one side of the line and an outlet flow path on the opposite side of the line, the inlet flow path being in fluid communication with inlet, the outlet flow path being in fluid communication with the outlet, and each of the inlet and outlet flow paths being in fluid communication with the chamber; and a medium directing member disposed within the disk unit, the medium directing member, the first and second connecting members and the chamber being configured such that the heat exchange medium is directed to flow from the inlet, through the inlet flow path, through the chamber, through the outlet flow path, and into the outlet.

2. The heat exchanging device according to claim 1, wherein said medium directing member and a chamber contour create at least two distinct flow patterns for the heat exchange media within the chamber.

3. The heat exchanging device according to claim 1, further including two manifolds with a plurality of holes, said manifolds arranged in a parallel fashion, set apart to a predetermined length to couple to free inlets or free outlets of the disk units.

4. The heat exchanging device according to claim 3, wherein the manifolds contain one or more baffles to direct flow of the heat exchange media within the manifolds.

5. The heat exchanging device according to claim 3, wherein a first manifold has a first hole functioning as an inlet coupled to the free outlet of a first disk unit, and a second manifold has a second hole functioning as an outlet coupled to the free inlet of a second disk unit to facilitate flow of the heat exchange media.

6. The heat exchanging device according to claim 3, wherein the first manifold has a first hole functioning as an inlet and a second hole functioning as an outlet to facilitate flow of the heat exchange media.

7. The heat exchanging device according to claim 1, wherein the disk members are made of one or more aluminum alloys, brazed together to form the disk unit.

8. The heat exchanging device according to claim 1, wherein the disk members are made of cladded material, brazed together to form the disk unit.

9. The heat exchanging device according to claim 1, wherein the tubular member on the first side of the first disk member is oval or a flat tubular shape.

10. The heat exchanging device according to claim 1, where the first and second connecting members are each a protrusion stamped to project outwardly from the second side of the at least one of the first and second disk members.

11. The heat exchanging device according to claim 1, where the first and second connecting members are each a material affixed to the second side of the at least one of the first and second disk members.

12. A heat exchanging device comprising:

a first disk member having an inlet formed as a tubular member on a first side of the first disk member;

a second disk member having an outlet formed as a tubular member on a first side of the second disk member, an outer periphery of the second sides of the first and second disk members engaging each other to form a disk unit, said disk unit having a chamber to facilitate flow of a heat exchange medium therein, at least one of the first and second disk members having on its second side first and second connecting members coupled to the other disk member and disposed on opposite sides of a line extending axially through the inlet and the outlet to define therebetween an inlet flow path on one side of the line and an outlet flow path on the opposite side of the line, the inlet flow path being in fluid communication with inlet, the outlet flow path being in fluid communication with the outlet and each of the inlet and outlet flow paths being in fluid communication with the chamber; and a medium directing member disposed within said disk unit, a first end of the medium directing member having a first channel formed at an angle, a second end of the medium directing member having a second channel formed at an angle, the second channel being disposed in a first side portion of the medium directing member which is generally diagonally opposite from a second side portion of the medium directing member in which the first channel is disposed, the first channel being in alignment with the inlet flow path and the second channel being in alignment with the outlet flow path.

13. The heat exchanging device according to claim 12, wherein said medium directing member and a chamber contour create at least two distinct flow patterns for the heat exchange media within the chamber.

14. The heat exchanging device according to claim 12, further including two manifolds with a plurality of holes, said manifolds arranged in a parallel fashion, set apart to a predetermined length to couple to free inlets or free outlets of the disk units.

15. The heat exchanging device according to claim 14, wherein the manifolds contain one or more baffles to direct flow of the heat exchange media within the manifolds.

16. The heat exchanging device according to claim 14, wherein a first manifold has a first hole functioning as an inlet coupled to the free outlet of a first disk unit, and a second manifold has a second hole functioning as an outlet coupled to the free inlet of a second disk unit to facilitate flow of the heat exchange media.

17. The heat exchanging device according to claim 12, wherein the first end of the medium directing member has a contour, except at the first channel, to match a contour of the inlet, and the second end of the medium directing member has a contour, except at the second channel, to match a contour of the outlet.

18. The heat exchanging device according to claim 12, wherein the disk members are made of one or more aluminum alloys, brazed together to form the disk unit.

19. The heat exchanging device according to claim 12, wherein the disk members are made of cladded material, brazed together to form the disk unit.

20. The heat exchanging device according to claim 12, wherein the tubular member on the first side of the first disk member is oval or a flat tubular shape.

21. The heat exchanging device according to claim 12, where the first and second connecting members are each a protrusion stamped to project outwardly from the second side of the at least one of the first and second disk members.

22. The heat exchanging device according to claim 12, where the first and second connecting members are each a material affixed to the second side of the at least one of the first and second disk members.

23. A method of making a heat exchanging device comprising:

providing a first generally planar material having a first port formed as a tubular member on a first side of said first material;

forming said first material to provide first and second protrusion members, a first flow path, and a second flow path on a second side of said first material, the first and second flow paths being disposed between the first and second protrusion members;

cutting a desired shaped disk member out of said first material, forming a first disk member;

providing a second generally planar material having a second port formed as a tubular member on a first side of said second material;

cutting a desired shaped disk member out of said second material, forming a second disk member;

forming a medium directing member having a first channel cut at an angle on a first end and a second channel cut at an angle on a second end;

disposing said medium directing member such that the first end of said medium directing member engages the first port of the first disk member with the first channel being aligned with the first flow path, and the second end of said medium directing member engages the second port of the second disk member with the second channel being aligned with the second flow path; and coupling together said first and second disk members on their respective second sides to form a disk unit having a chamber, the protrusion members of the first disk member engaging the second side of the second disk member leaving the first and second flow paths, each of the first and second flow paths being in fluid communication with the chamber.

24. The method according to claim 23 wherein the first generally planar material and the second generally planar material are formed into desired shape by stamping said materials.

25. The method according to claim 23 wherein the first generally planar material and the second generally planar material are formed into desired shape by machining said materials.

26. The method according to claim 23 wherein the first disk member and the second disk member are coupled together by folding an annular wall on the second disk member onto the first side of the first disk member.

27. The method according to claim 23 wherein a plurality of disk units are formed, and the second port of a first disk unit is coupled to the first port of a second disk unit.

* * * * *